United States Patent [19]

Otoshima et al.

[11] Patent Number: 4,760,969

[45] Date of Patent: Aug. 2, 1988

[54] PACKAGE YARN PROCESSING DEVICE

[75] Inventors: Hiroo Otoshima; Yasunori Hatakeyama, both of Shiga, Japan

[73] Assignee: Murata Kikai Kabushiki Kaisha, Kyoto, Japan

[21] Appl. No.: 109,576

[22] Filed: Oct. 16, 1987

[30] Foreign Application Priority Data

Oct. 24, 1986 [JP] Japan ..... 61-253919

[51] Int. Cl.[4] ..... B65H 54/00

[52] U.S. Cl. ..... 242/18 R; 242/18 PW; 242/18 EW; 242/35.5 R; 242/35.6 E

[58] Field of Search ..... 242/18 R, 18 PW, 18 EW, 242/35.5 R, 35.5 A, 35.6 R, 35.6 E, 164, 165, 172; 289/1.5, 2, 5, 6, 12

[56] References Cited

U.S. PATENT DOCUMENTS

| | | | |
|---|---|---|---|
| 4,384,689 | 5/1983 | Bloomfield et al. | 242/18 EW |
| 4,576,340 | 3/1986 | Aretz et al. | 242/35.5 A |
| 4,606,509 | 8/1986 | Hiroaki | 242/35.6 R |
| 4,619,416 | 10/1986 | Matsui et al. | 242/35.5 R |
| 4,630,782 | 12/1986 | Rohner | 242/18 EW |
| 4,634,065 | 1/1987 | Kupper et al. | 242/18 R |
| 4,681,271 | 7/1987 | Matsui et al. | 242/18 R |
| 4,705,224 | 11/1987 | Akiyama et al. | 242/35.6 E |
| 4,723,720 | 2/1988 | Matsui et al. | 242/18 R |

*Primary Examiner*—Stanley N. Gilreath

*Attorney, Agent, or Firm*—Spensley Horn Jubas & Lubitz

[57] ABSTRACT

A device for processing a yarn of a package, wherein a device for processing the yarn of an outer yarn layer of the package and a device for processing a bunch winding yarn of the package are disposed along a feeding path for the package, and the device for processing the yarn of an outer yarn layer includes a yarn knotting device for knotting the yarn of the outer layer of the package at a predetermined position of a surface of the package to form a knot of the yarn while the device for processing a bunch winding yarn includes a mechanism for releasing the bunch winding yarn at an end portion of a bobbin and a mechanism for positioning and fixing an end segment of the yarn.

17 Claims, 19 Drawing Sheets

P1
74
Y2
82
Y3
9

87

Y4

Y4
Y2

86
82
85
Y2

173
168
157
152
156
155
153
161
160
159
158
Y11
165
166
164
172
151
163a
167
Y13
163
162

PACKAGE YARN PROCESSING DEVICE

FIELD OF THE INVENTION

This invention relates to a device for processing a yarn of a package.

RELATED ART STATEMENT

A package which has been wound up with a continuously spun yarn, for example, on a spinning yarn winder is then either transported to a desired next step or forwarded as a product. Anyway, such a package is processed by a hand of a worker such that an end segment of a yarn at a winding stopping end is wrapped on an outer periphery of the package and a knot of the yarn is formed at the yarn end in order to prevent natural releasing of the yarn of an outermost yarn layer during transportation of the package or bunch windings at a winding starting end of a package are released and an end of a yarn which is firmly fitted in a yarn catching slit formed at an end portion of a paper spool is drawn out in order to facilitate an operation to join ends of yarns of different packages to each other at a next step.

In an operation of making a knot at an end of a yarn of an outer layer of a package as described above, it is necessary to keep constant the length of a knot, the position of the knot on the package, the binding strength of the knot or the like in consideration of the operability when the knot is to untied at a subsequent step. Further, in processing a yarn of bunch windings, the operation of releasing an end segment of a yarn which is firmly fitted in a slit at an end portion of a paper spool is very troublesome and may damage a surface of the paper spool which is to be repetitively used.

OBJECT AND SUMMARY OF THE INVENTION

It is an object of the present invention to provide a device for processing a yarn of a package automatically, and for enabling automatical transference of the package.

The present invention provides a device for processing a yarn of a package, wherein a device for processing the yarn of an outer yarn layer of the package and a device for processing a bunch winding yarn of the package are disposed along a feeding path for the package, and the device for processing the yarn of an outer yarn layer includes a yarn knotting device for tying the yarn of the outer layer of the package at a predetermined position of a surface of the package to form a knot of the yarn while the device for processing a bunch winding yarn includes a mechanism for releasing the bunch winding yarn at an end portion of a bobbin and a mechanism for positioning and fixing an end segment of the yarn.

DETAILED DESCRIPTION OF THE INVENTION

Now, an embodiment of device of the present invention will be described with reference to the drawings.

Figure 2:
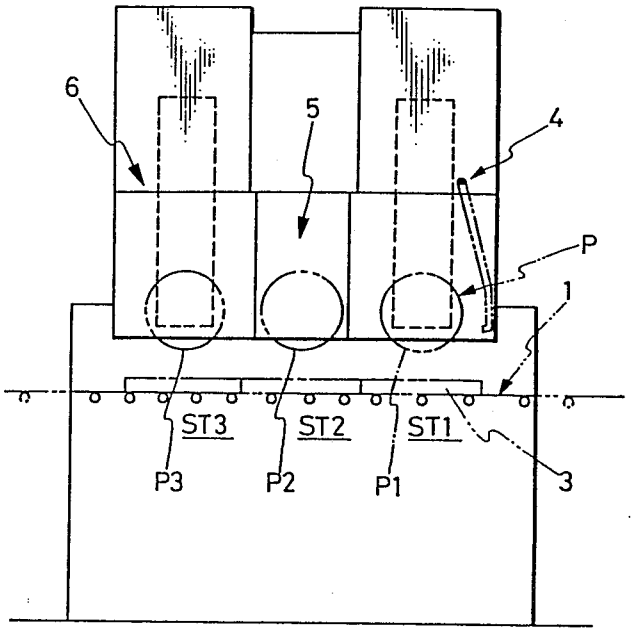
Figure 1:
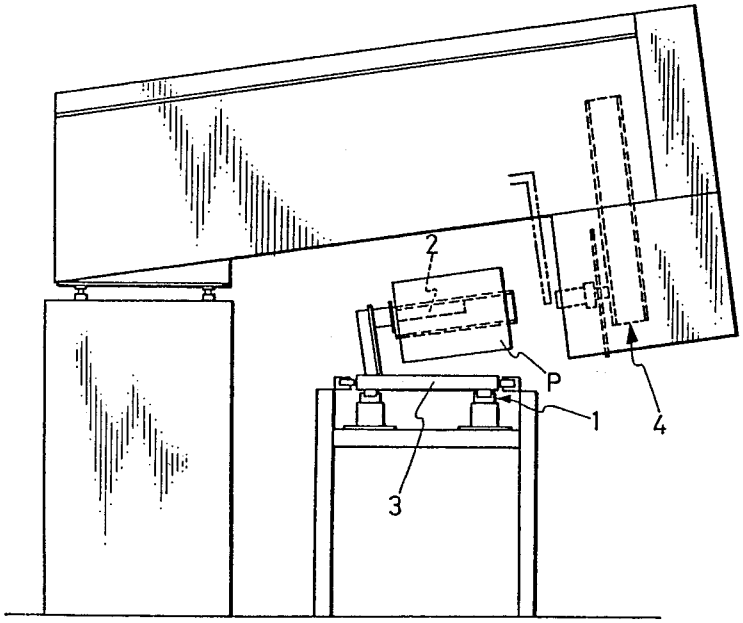
FIG. 1 is a schematic view showing relative positions between a device of the present invention and a package, FIG. 2 a front elevational view of the arrangement of FIG. 1, FIGS. 3 to 18 show various devices at a first stage, and FIG. 3 being a side elevational view of an entire processing equipment at the first state, FIG. 4 a front elevational view of the processing equipment of FIG. 3, FIGS. 5A, 5B to 7A, 7B being schematic illustrations showing a step of releasing a yarn, FIG. 8 being a front elevational view of a sensor for detecting completion of a waste yarn releasing operation, FIG. 9 a side elevational sectional view of a package grasping device, FIG. 10 a front elevational view showing relative positions of a roller 58 and a bobbin B, FIG. 11A a view illustrating a mechanism for rotating a yarn hanging guide 74, FIG. 11B a side view showing a supporting mechanism of the yarn hanging guide, FIG. 11C an enlarged front view of the yarn hanging guide, FIG. 12 a side elevational sectional view of a bill device for knotting a yarn, FIG. 13 a left-hand side elevational view of FIG. 12, FIG. 14 a schematic illustration showing a principle of formation of a yarn knot, FIGS. 15A to 15E being views illustrating a yarn knotting step by the bill device of the present embodiment, FIG. 16 a front elevational view showing part of the yarn knotting step of FIGS. 15A to 15E, FIG. 17 a front elevational view showing relations of the package, the bill device and a guide plate 92 for a knot, FIG. 18 a side elevational view showing a cutter device.

Referring to FIGS. 1 and 2, a package P which has been doffed by a spinning yarn winder is fitted and supported on a peg 2 of a tray 3 and fed together with the tray 3 by a roller conveyor 1. Intermediate the feeding path 1, the tray and hence the package P are positioned successively to 3 positions P1, P2 and P3 at which required processing operations of an end of a yarn which will be hereinafter described are effected. The 3 positions of the package will be hereinafter referred to, in the order as listed from the right-hand side in FIG. 2, as a first stage ST1, a second stage ST2 and a third stage ST3.

Installed at the first stage ST1 is a yarn knotting device 4 for wrapping an end segment of a yarn of an outermost yarn layer of a package around a periphery of the package so as to fix the yarn end segment. A bunch winding yarn releasing device 5 is installed at the second stage ST2, and a yarn end wrapping and fixing device 6 is installed at the third stage ST3.

Now, the individual devices will be described in detail.

(I) Yarn Knotting Device

Figure 3:
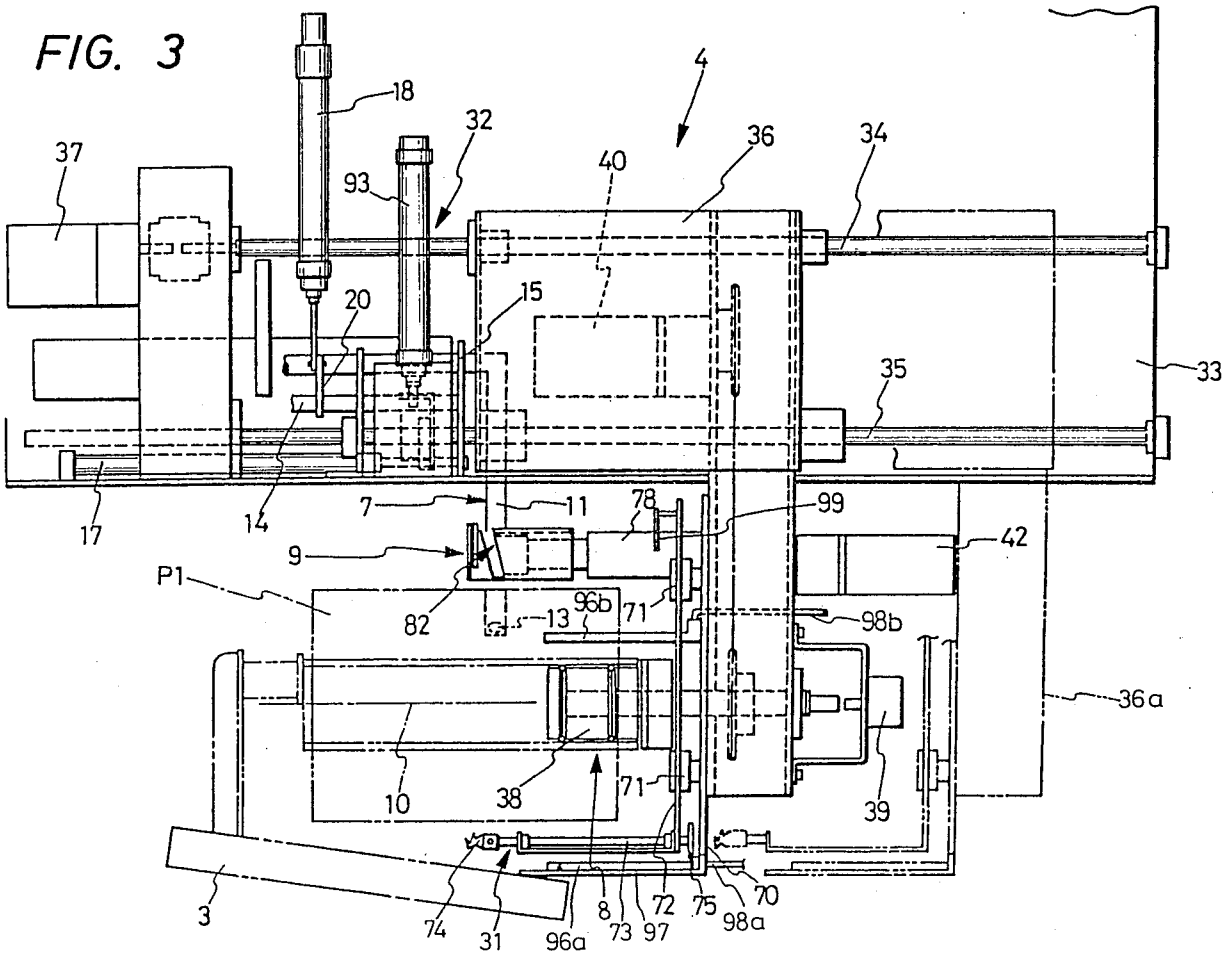
Figure 4:
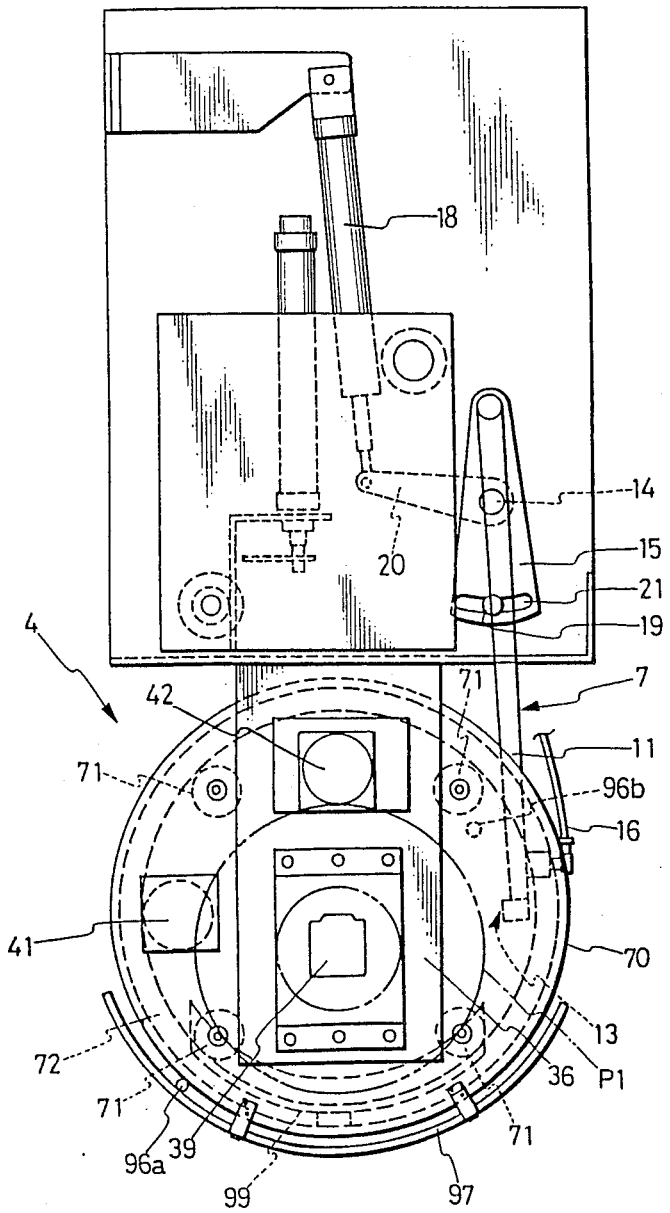

Referring to FIGS. 3 and 4, the yarn knotting device 4 includes a waste yarn removing mechanism 7 for removing waste yarns wound on an outermost yarn layer of a package, a yarn knotting mechanism, and so on.

(I-i) Waste Yarn Removing Mechanism

Figure 8:
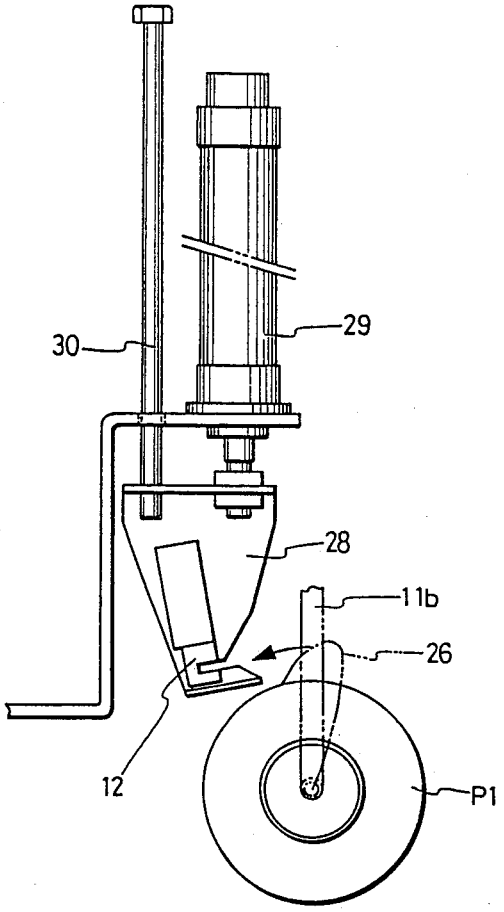

Referring to FIGS. 3 and 4, the waste yarn removing mechanism 7 includes a suction pipe 11 mounted for sliding movement in parallel to an axis 10 of a package P1 near an outer periphery of the package and also for pivotal motion at a position thereof adjacent an end of the package in a direction perpendicular to the axis 10 of the package, and a waste yarn removal confirming sensor 12 shown in FIG. 8.

The suction pipe 11 has a suction opening 13 formed therein so as to be directed toward an outer periphery of the package and is supported at an upper end portion of a rockable plate 15 which is in turn mounted for rocking motion within a predetermined angular range around a shaft 14. A compressed air supply pipe 16 is connected to the suction pipe 11 for jetting compressed air in a direction toward the interior of the suction pipe 11 from a portion near an end of the pipe 11 so that a sucking action may occur at the open end of the suction pipe 11.

Sliding movement of the suction pipe 11 is effected in an integral relationship with the rockable plate 15 by a hydraulic cylinder 17. Meanwhile, pivotal motion of the suction pipe 11 around the shaft 14 is effected by a hydraulic cylinder 18 extending in a direction perpendicular to the cylinder 17 as shown in FIG. 4 and having a piston rod connected to a lever 20 which is secured at the other end thereof for integral rotation with the rockable plate 15 around the fixed shaft 14. It is to be noted that the end of the piston rod 19 for slidably moving the suction pipe 11 is loosely fitted in an arcuate slot 21 of the rockable plate 15 so that rocking motion of the plate 15 may not move the piston rod 19.

Figure 5A:
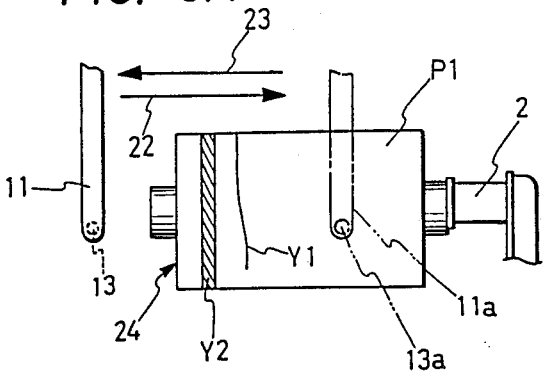
Figure 5B:
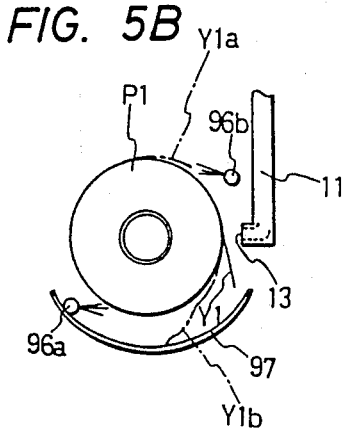
Figure 6A:
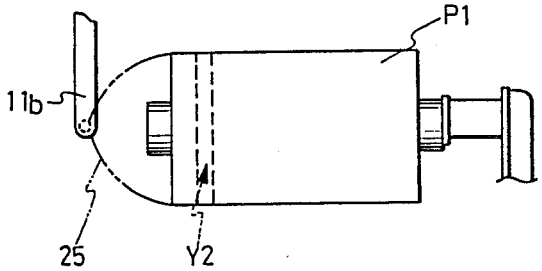
Figure 6B:
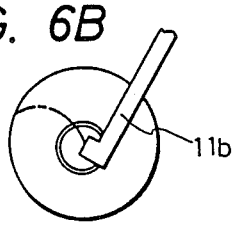
Figure 7A:
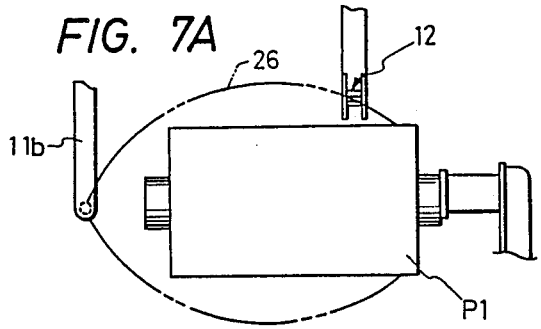
Figure 7B:
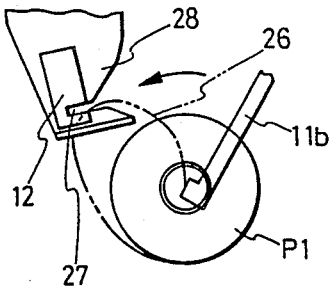

Operations of the device described above are illustrated in FIGS. 5A to 7B. In particular, if the suction pipe 11 of FIGS. 5A, 5B is slidably moved by a predetermined stroke from a stand-by position in a direction indicated by an arrow mark 22 in parallel to the axis of the package, an end segment Y1 of a yarn which either hangs down from the package or sticks to a surface of the package will be sucked into the opening 13 of the suction pipe 11*a*. In this condition, the suction pipe 11 is then slidably moved in a direction of an arrow mark 23 in FIG. 5A to a position spaced away from an end face 24 of the package. Subsequently, the suction pipe 11 is pivoted around the shaft 14 of FIG. 4 toward the center of the package as shown in FIG. 6B. Thus, when the suction pipe 11 assumes a position 11*b* as shown in FIG. 6B, the yarn is sucked further deeply into the suction pipe 11 by the sucking force of the latter until a yarn segment at a waste yarn portion Y2 wound around the package is released. It is to be noted that, in this instance, the package P1 is not rotated. As the yarn is released in this manner, a balloon 25 of the yarn will be produced, and when releasing and removal of the waste yarn portion is completed, a regular yarn releasing operation for a surface of the package is entered. Consequently, the yarn which is being ballooned 26 as shown in FIGS. 7A, 7B will finally be introduced by a guide plate 28 into a yarn sensing groove 27 of the sensor 12 which has been moved to and is in a stand-by condition at a predetermined position within a locus of such balloon, and accordingly the yarn will be detected by the sensor 12. Thus, as the sensor 12 detects the yarn, it is determined that removal of the waste yarn is completed, and accordingly a next yarn knotting step is entered. It is to be noted that the sensor 12 is secured to the guide plate 28 as shown in FIG. 8 and is moved up and down by a hydraulic cylinder 29. Reference numeral 30 denotes a guide rod.

It is to be noted that when the sensor 12 does not detect a yarn, that is, when the sensor 12 does not operate even if a predetermined time elapses after starting of operation of the suction pipe 11, it is determined that sucking of an end segment of a yarn has failed. In this case, a control device such as a sequencing circuit not shown will control the suction pipe 11 to repeat the sequence of operations described above while compressed air is jetted from yarn end releasing nozzles 96*a*, 96*b* in a direction to release the yarn on the surface of the package.

In particular, referring to FIGS. 3, 4, the nozzle pipe 96*a* is secured to an upper face of a yarn end dropping preventing plate 97 in the form of a curved wire gauze which is secured to a disk-shaped base 70 and arranged so as to cover the package while the other nozzle pipe 96*b* is secured to the base 70, and supply pipes 98*a*, 98*b* for the nozzle pipes 96*a*, 96*b* are connected to a compressed air source not shown. Each of the nozzle pipes 96*a*, 96*b* has a compressed air jetting hole formed at a location thereof opposing to the waste yarn portion Y2 of the package shown in FIG. 5A so that compressed air may be jetted in direction substantially tangential to the surface of the package so as to release the yarn from the package.

Accordingly, in case, for example, the end segment Y1*a* of the yarn sticking to the surface of the package P1 is positioned at such a high position as shown in FIG. 5B that the sucking force of the suction pipe 11 may not reach, the yarn end segment Y1*a* will not be caught by the operation only of the suction pipe 11 described above, and in this case, air is jetted from the nozzles 96*a*, 96*b* as shown in FIG. 5B in response to a yarn absence signal from the sensor 12. Consequently, a condition in which the yarn end segment Y1*b* hangs down on the dropping preventing plate 97 is reached, and accordingly the suction pipe 11 is rendered operative again so that the yarn end segment is sucked into the suction pipe 11. After then, the waste yarn portion is removed.

It is to be noted that reference numeral 99 denotes an entangling preventing plate mounted on a rotary ring 72 for preventing a released yarn from being entangled with the ring, and the entangling preventing plate 99 is formed from an arcuate plate as shown in FIG. 4 and is revolved round the package together with the ring 72.

(I-ii) Yarn Knotting Mechanism

The yarn knotting mechanism includes a package grasping and rotating device 8, a yarn laying device 31 for scooping up a portion of a yarn on an outer layer of a package and for forming a loop of the yarn at a location spaced away from a surface of a package, a bill device 9 for receiving a yarn segment from the yarn laying device 31 and for knotting the same, a cutter device 32 for cutting a yarn segment extending to the suction pipe after completion of knotting of the yarn, and so on.

The various devices constituting the yarn knotting mechanism are mounted on a slide frame 36 which is slidably moved along a screw shaft 34 and a guide rod 35 of a body frame 33 shown in FIGS. 1 and 3. The slide frame 36 waits at a position 36*a* shown in two-dot chain lines in FIG. 3 until removal of waste yarn is completed, and as a motor 37 shown in FIG. 3 and the screw shaft 34 rotate, the slide frame 36 is moved to a position for yarn knotting.

As shown in FIGS. 3, 4, the slide frame 36 has mounted thereon a package grasping and rotating chuck 38 as well as a chuck grasping cylinder 39 and a motor 40 for rotating the chuck grasping cylinder 39, the yarn laying device 31 which is turned around the package grasped by the chuck 38 to deliver a yarn segment to the bill device 9 and a motor 41 for driving the yarn laying device 31, the bill device 9 for forming a yarn knot and a motor 42 for driving the bill device 9, and so on. The various devices make a parallel motion in a leftward and rightward direction in FIG. 3 in an integral relationship with the frame 36 and can be positioned to a yarn end processing position shown in solid lines at which an end of a yarn of a package P1 is processed and the stand-by position 36*a* shown in two-dot chain lines in FIG. 3.

Figures 9, 10:
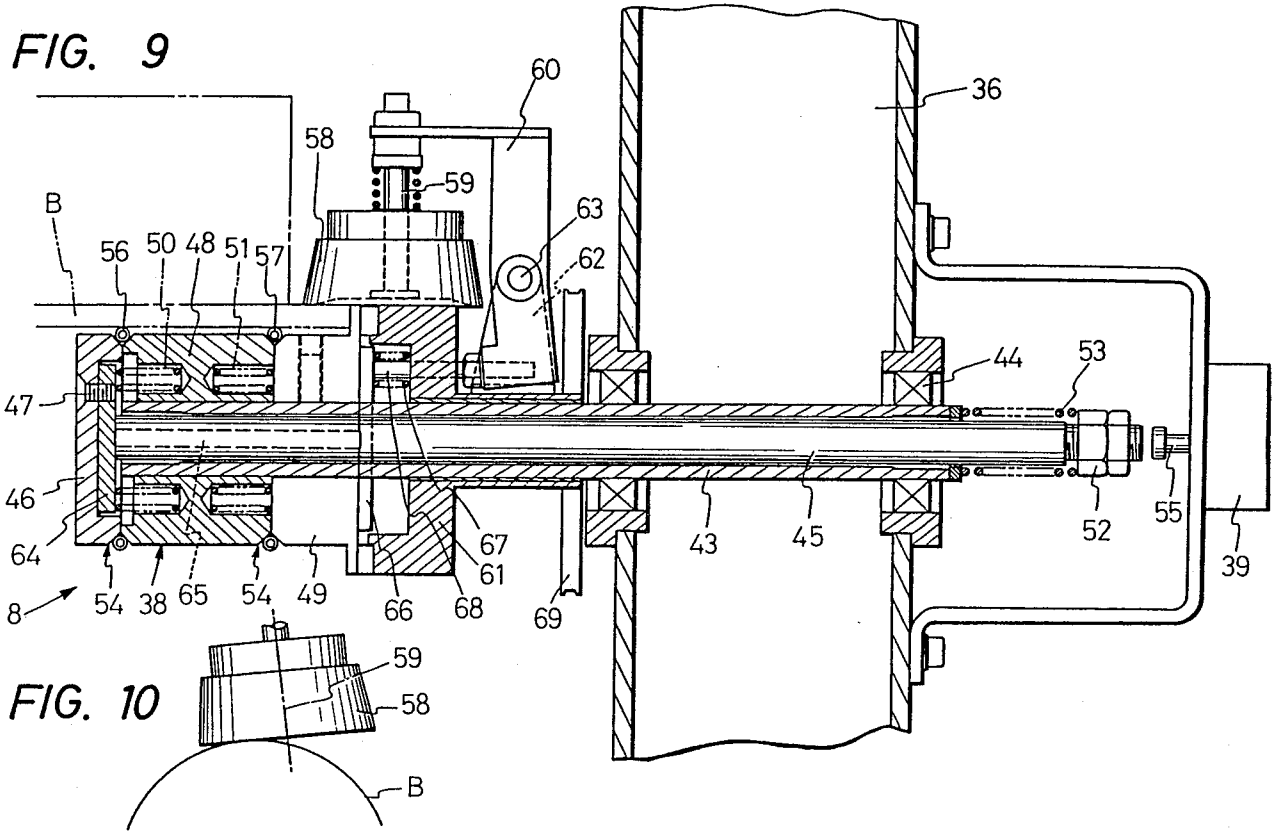

The package grasping chuck 38 is show in detail in FIG. 9. In particular, a cylindrical shaft 43 extends through the frame 36 and is supported for rotation by means of bearings 44. A rod 45 extends through a center hole of the shaft 43, and a movable chuck member 46 in the form of a disk is screwed 47 to a package side end of the rod 45. Another movable chuck member 48 is fitted for sliding movement on the shaft 43, and a fixed chuck member 49 is secured to the shaft 43. Reference numeral 50 denotes a compression spring interposed between the movable chuck members 46, 48, and 51 denotes another compression spring interposed between the movable chuck member 48 and the fixed chuck member 49. Meanwhile, a further compression spring 53 having a greater spring force than the springs 50, 51 is interposed between a nut member 52 secured to the other end of the rod 45 and the other end face of the shaft 43 to normally urge the rod 45 in the rightward direction in FIG. 9 to contact the chuck members 46, 48, 49 closely with each other. Inclined portions are formed on adjacent end faces of the chuck members, and pressing pieces 56, 57 consisting of ringshaped coil springs for pressing against an inner circumferential face of a bobbin of a package are fitted in bottom portions 54 each formed by the inclined portions of each two adjacent end faces of the chuck members 46, 48, 49. Accordingly, when a package is to be fitted on the chuck members, a piston rod 55 is moved leftwardly by the cylinder 39 to move the rod 45 leftwardly against the spring 53. Consequently, the chuck member 46 at the end of the rod 45 is moved leftwardly by a predetermined distance whereupon the other movable chuck member 48 is caused to follow to move by the springs 50, 51. As a result, a gap is produced between the chuck members 46, 48 and also between the chuck members 48, 49, and the pressing pieces 56, 57 are a little advanced into the thus opened bottom portions, thereby decreasing the diameters of the ring-shaped pressing pieces. Accordingly, if in this condition the frame 36 is slidably moved toward the package, the chuck members 46, 48, 49 are advanced into the bobbin of the package. Subsequently, the chuck cylinder 39 is turned off. Consequently, the rod 45 is moved rightwardly by the force of the spring 53, thereby returning the chuck members 46, 48 and the pressing pieces 56, 57 to respective initial positions thereby to press the bobbin B of the package from inside to grasp the same.

It is to be noted that, referring to FIG. 9, reference numeral 58 denotes a roller for preparing for releasing of a bunch winding yarn, and as shown in FIG. 10, the roller 58 is located for contact with the outer periphery of the bobbin in a somewhat inclined relationship such that a center shaft 59 of the roller 58 may be displaced from the center shaft 10 of the package P1. The roller 58 can rotate freely around the shaft 59 while a lever 60 on which the shaft 59 is supported at 63 for pivotal motion on a bracket 62 on a cylindrical member 61 which is in turn mounted for rotation on the shaft 43. The lever 60 can be pivoted within a limited small range around the shaft 63. In particular, a disk member 64 is secured to the end of the rod 45 and has a plurality of pins 65 secured in an equal pitch along a circle to an end face thereof. The pins 65 extend through the chuck members 48, 49, and the other ends thereof are abutted with a disk member 66 which is loosely fitted on the shaft 43. A compression spring 67 is interposed between the disk member 66 and the rotary member 61, and a pin 68 secured to an end portion of the lever 60 extends through the rotary member 61 and is abutted with the disk member 66. Accordingly, if the rod 45 is moved leftwardly, the disk member 66 is pushed to move leftwardly by the spring 67. Accordingly, the roller 58 and the bobbin B are spaced away from each other and, following the package P1 being grasped by the chuck 38, is pressed against the surface of the bobbin B.

The rotary member 61 is formed in an integral relationship with a pulley 69, and accordingly as the pulley 69 rotates, the rotary member 61 is rotated around the shaft 43. Consequently, the rotary member 61 is revolved around the bobbin along the surface of the bobbin while being rotated around its axis due to its contact with the surface of the bobbin thereby to displace outer ones of the bunch winding yarn layers toward the package end face side so as to expose a yarn layer portion to be fitted into the slit.

Figure 11A:
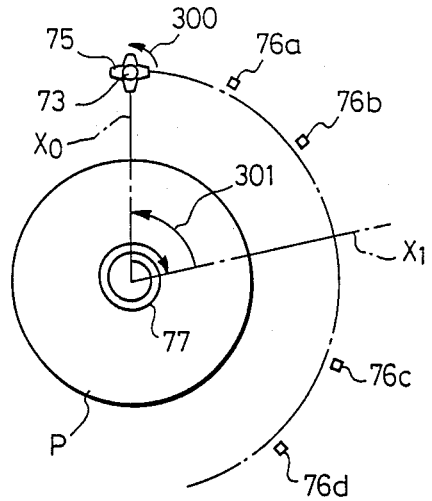
Figure 11B:
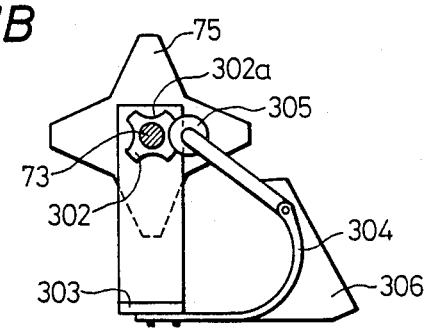
Figure 11C:
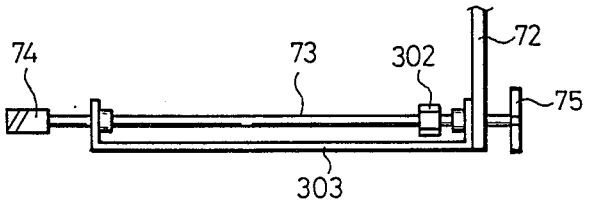
Figures 15A, 15B, 15C, 15D, 15E:
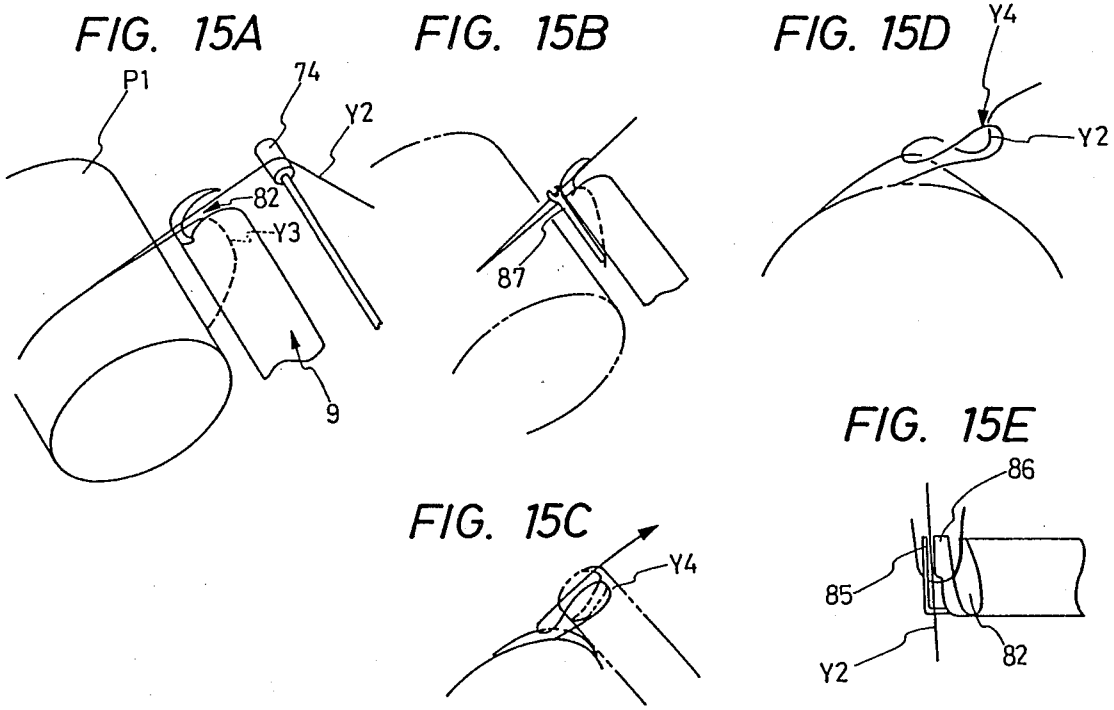

Now, the yarn laying device 31 for delivering a yarn of an outer layer of a package to the bill device will be described with reference to FIGS. 3 and 4. The yarn laying device includes a rotary ring 72 for internal contact with four guide rollers 71 secured to an end face of a base member 70 in the form of a disk secured to the frame 36, and a spiral yarn hanging guide 74 secured to an end portion of a shaft 73 which is located on the rotary ring 72 in an integral relationship to the axis of the package. Reference numeral 41 denotes a motor for rotating the ring 72, and a roller secured to an output power shaft of the motor 41 is contacted with an inner periphery of the ring 72 so as to rotate the ring 72. Further, a substantially cross-shaped cam piece 75 as shown in FIG. 11 is secured to the other end portion of the shaft 73 of the spiral guide 74 while engaging pieces 76 for engaging with the cam piece 75 are secured to the base member 70 at four locations in the present embodiment. When the cam piece 75 is rotated around the package P in a direction of an arrow mark 77, it is rotated of one fourth of one complete rotation about a shaft 73 in a direction of an arrow mark 300 by means of engaging pieces 76*a* to 76*d* which are located at four different positions, respectively. Accordingly, after about two and a half revolution of the cam piece 75 around the package, the cam piece 75 arrives at a position of a line X1. At this position, the yarn Y3 falls from the spiral guide 74 as shown in FIG. 15A.

Then, the cam piece 75 is rotated in a counterclockwise direction and is returned (301) to the original position X0 (FIG. 11A), and the yarn knotting operation is started. A positioning member 302 is secured on the shaft 73 and four arcuate concave portions 302*a* are formed on the circumferential face of the positioning member. The roller 305 which is supported on the top end of an arm 304 supported on a bracket 303 engages with one of the arcuate concave portions 302*a* and the roller 305 is urged against the arcuate concave portion by means of a spring plate 306. It is to be noted that while the number of the engaging pieces 76 is optional, it must only be such that when the spiral guide 74 catches a yarn extending between the suction pipe and the package in order to form a double ring of the yarn, a portion of the yarn first caught is removed from an end of the guide 74 after 2 rotations of the ring and transferred to the bill device 9 while only a second portion of the yarn remains on the guide 74, and a suitable number is selected in accordance with the spiral shape of the spiral guide 74.

Figure 13:
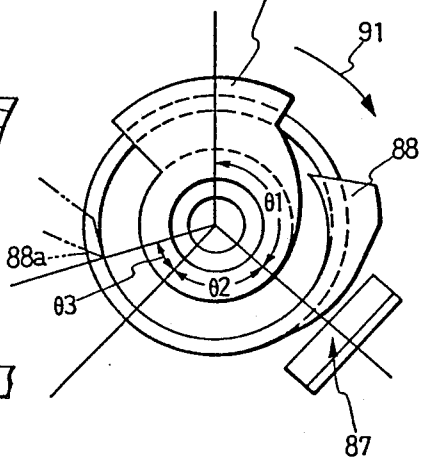
Figure 12:
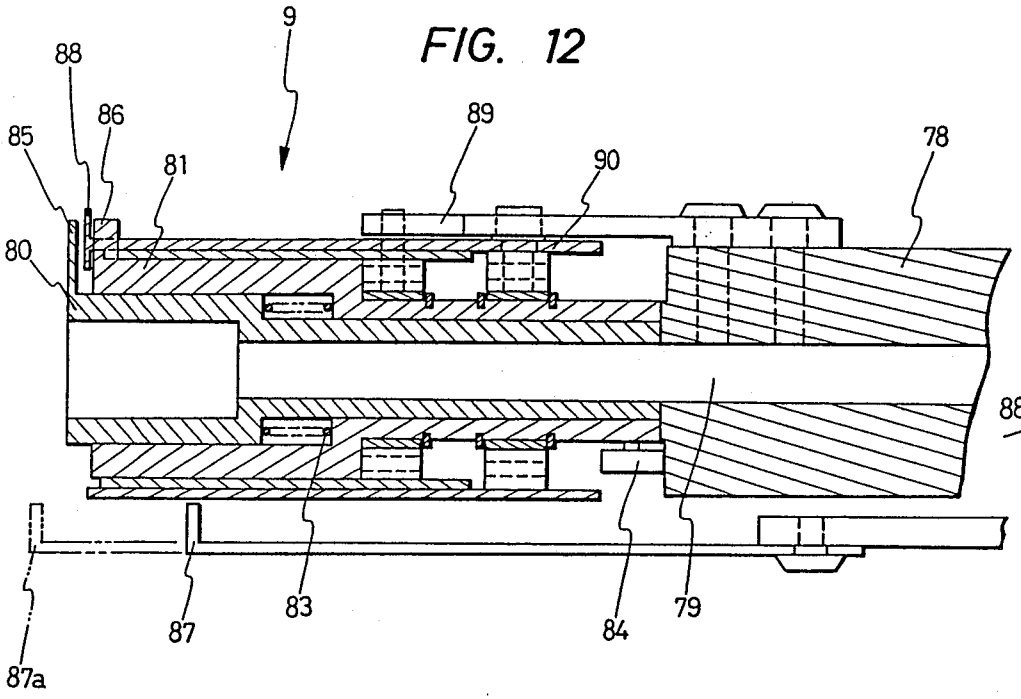

Now, the bill device for effecting yarn knotting will be described with reference to FIGS. 3, 12, 13. The bill device 9 is installed on the frame 36, and a support member 78 is secured to the frame 36 so that a yarn knot forming location may be substantially at or near the center of the package. A bill shaft 79 extends through the support member 78, and a clamp member 80 is secured to the bill shaft 79. A sliding clamp member 81 is mounted for sliding movement on an outer periphery of and relative to the clamp member 80 and forms a yarn clamping part at an end portion thereof. Each of the clamp members has a spiral groove 82, (refer to FIGS. 15A to 15E), formed therein, and a yarn is introduced into the grooves 82 by the yarn laying device and forms a loop as the bill shaft 79 is rotated. The loop of the yarn thus formed is slipped off from the clamp members. Referring to FIG. 12, a compression spring 83 is interposed between the sliding clamp member 81 and the clamp member 80, and a cam roller 84 is located on the sliding clamp member 81. Thus, the clamp member 81 is moved leftwardly or rightwardly via the cam roller 84 by a cam plate not shown secured to an end face of the support member 78 to open or close clamping members 85, 86 in order to control clamping or releasing of a yarn.

Further, reference numeral 87 denotes a yarn removing guide for removing a yarn extending to the yarn hanging guide 74 from the clamping pieces, and the yarn removing guide 87 is moved in a direction parallel to the axis of the bill shaft 79 by a cam not shown.

Further, reference numeral 88 denotes a yarn removing piece mounted on an outer periphery of the sliding clamp member 81, and the yarn removing piece 88 is rotated by a certain angle in an integral relationship with the clamp members 80, 81. But as a preset angle is reached, a portion 90 of the yarn removing piece 88 is abutted with a fixed stopper 89 while removing a loop of a yarn which has been engaged around the clamping pieces 85, 86.

Figure 14:
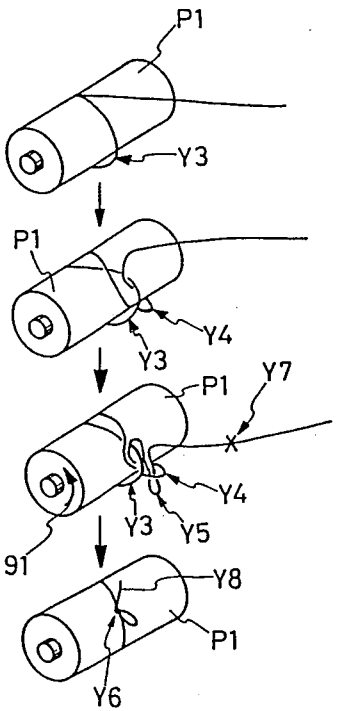

Now, operation of the yarn knotting device will be described. The principle of formation of a knot of a yarn according to the device of the present invention is illustrated in FIG. 14. In particular, a yarn segment Y4 connecting to the suction pipe is drawn out through a loop Y3 formed around the package P1, and then another yarn segment Y5 on the suction pipe side is drawn out through the loop Y4 formed by the yarn thus drawn out, whereafter the yarn segment Y5 thus drawn out is grasped while the package P1 is rotated in a direction of an arrow mark 91. Consequently, such entangled portion of the yarn is tightened and pressed against the outer periphery of the package, thereby forming a knot Y6. Then, if the yarn is cut Y7 at a suitable position, then a knot having a yarn end segment Y8 at which the yarn of the knot is to be pulled is formed. In other words, if the yarn is pulled at the yarn end segment Y8, then the knot is released readily.

Figure 16:
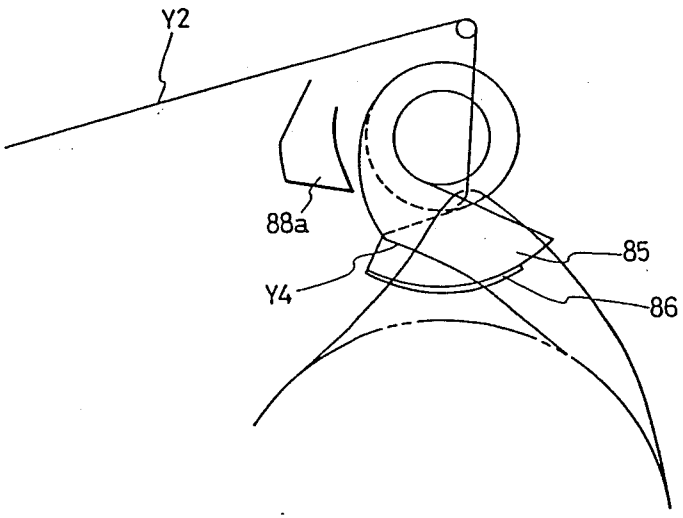
Figure 17:
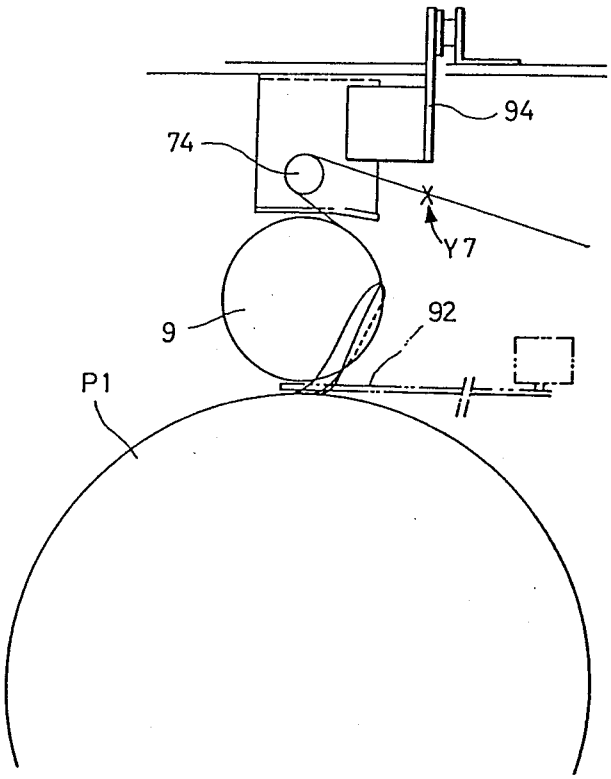

Such operations as described above are shown in FIGS. 15A to 16. FIG. 15A shows a state in which a yarn segment Y3 is delivered to the groove 82 of the bill device while another yarn segment Y2 is hanged to the guide 74 as the spiral guide 74 is rotated by two complete rotations around the package. From this state, the bill shaft 79 of FIG. 12 starts its rotation in the direction of the arrow mark 91 in FIG. 13 to start advancement of the yarn removing guide 87 toward a position 87*a* shown in two-dot chain lines in FIG. 12. At a point of time when the clamp members 85, 86 and yarn removing piece 88 are rotated in an integral relationship by an angle $\theta 1$ of FIG. 13, a first loop (Y4 of FIG. 16, or Y4 of FIG. 15C) is formed by the yarn removing guide 87. As the bill shaft 79 is rotated further by an angle $\theta 2$ and the spiral guide 74 is revolved by a predetermined angle in a counterclockwise direction in FIG. 16, the yarn segment Y2 on the suction pipe side is positioned between the clamp members 85, 86 as shown in FIG. 15E. As the bill shaft 79 is further rotated by an angle $\theta 3$ of FIG. 13, the clamp members 85, 86 are closed to clamp the yarn segment Y2 of FIGS. 15D, 15E therebetween while the loop Y4 outside the clamp members 85, 86 are removed from the clamp members by a stopping piece 88*a* of FIG. 16. In this condition, the clamped yarn segment Y5 is pulled and the package P1 is rotated a little. Consequently, a knot Y6 as shown in FIG. 14 is tightened and formed on the surface of the package. It is to be noted that, in this instance, a guide lever 92 for positioning a location at which a knot is to be formed as shown in FIG. 17 is advanced to a position between the surface of the package and the bill device 9 and is thus positioned at the central position on the surface of the package in the direction of the axis.

Figure 18:
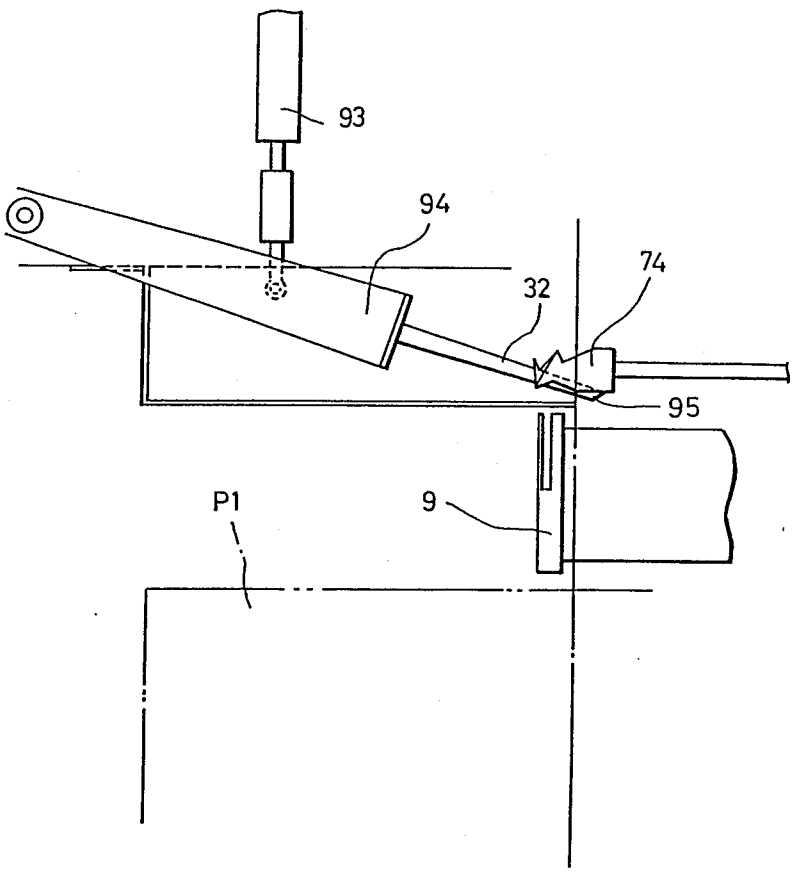

Subsequently, the yarn is cut at an intermediate location between the guide 74 and the knot by the cutter device 32 as shown in FIG. 18, thereby forming a knot Y6 having an end segment Y8 of the yarn of a predetermined length as shown in FIG. 14. It is to be noted that, for example, a heat cutter is suitable as the cutter device 32 because cut ends of chemical fibers of the yarn become solid by heat and will not become loose. Naturally, mechanical scissors may be used. The cutter device 32 includes a heat cutter 95 provided at an end portion of a lever 94 which can be pivoted by a hydraulic cylinder 93, and the lever 94 is moved to a full line position only at a final stage of yarn knotting but normally waits at a position at which it does not interfere with yarn knotting.

The yarn knotting process will be described more in detail.

Figure 29A:
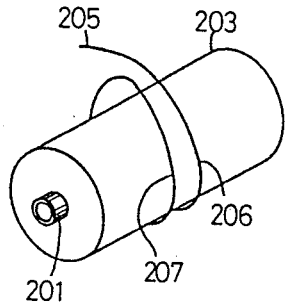

FIGS. 29A to 29F illustrate the yarn knotting process of the present invention, and at first, as shown in FIG. 29A, a yarn is made loose from a yarn end segment 205 at an outermost layer of a package 203 to form on an outer periphery of the package 203 an outer loop 206 connecting to the yarn end segment 205 and an inner loop 207 connecting to the outer loop 206.

Figure 29B:
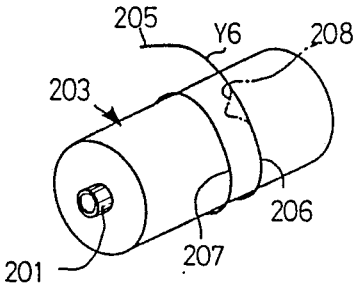
Figure 29C:
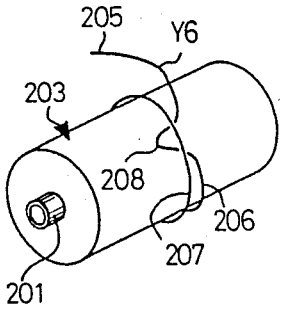

Subsequently, a yarn segment Y6 of the outer loop 206 is bent to form a hooked loop 208 as shown in FIG. 29B, and the hooked loop 208 is passed through the inner loop 207 as shown in FIG. 29C.

Figure 29D:
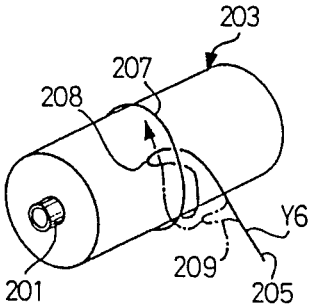

In this condition, the yarn end segment 205 of the outer loop 206 is moved forwardly as shown in FIG. 29D, and the yarn segment Y6 thereof is bent as shown in a two-dot chain line in FIG. 29D to form a drawing loop 209. After then, the drawing loop 209 is passed as indicated in two-dot chain lines in FIG. 29D, that is, passed over the outside of the inner loop 207 and then through the hooked loop 208 from below to above.

Figure 29E:
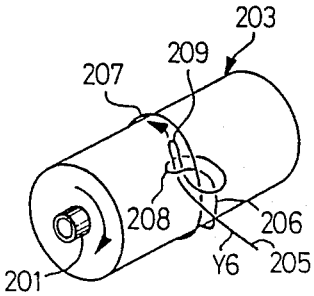
Figure 29F:
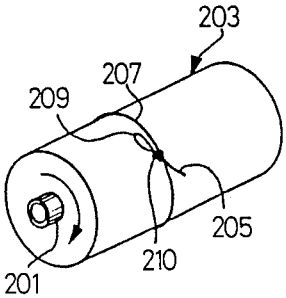

Then, as shown in FIG. 29E, the package 203 is rotated in a direction to wind a yarn onto the package 203 as shown in a solid line in FIG. 29E while the drawing loop 209 passed through the hooked loop 208 is kept pulled in a direction shown in a solid line in FIG. 29E. Consequently, the yarn segments of the inner loop 207 and the outer loop 206 form a knot 210 as shown in FIG. 29F while being wrapped around the outer periphery of the package 203.

On the other hand, when the knot 210 formed on the outer periphery of the package 3 is to be removed for use, the yarn end segment 205 of the knot 210 will be pulled so that the knot 210 can be untied readily.

FIG. 30 illustrates another embodiment of yarn knotting process of the present invention.

The present embodiment is basically similar to the preceding embodiment of FIGS. 29A to 29F and is different in that the direction of twist of a yarn is opposite to that of FIGS. 29A to 29F.

Figure 30A:
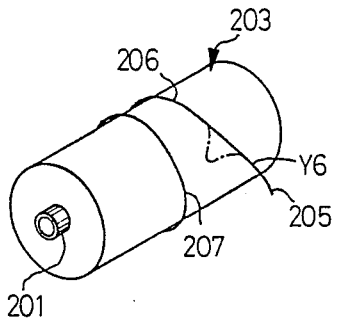
Figure 30B:
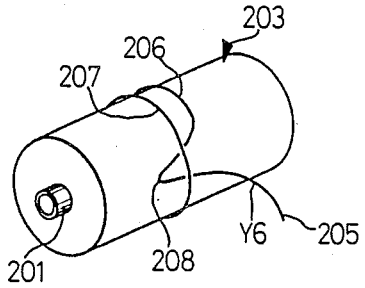
Figure 30C:
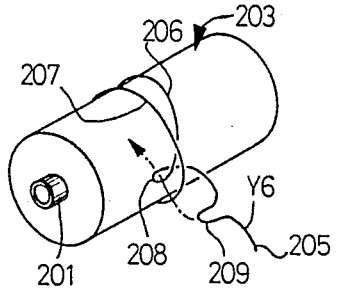
Figure 30D:
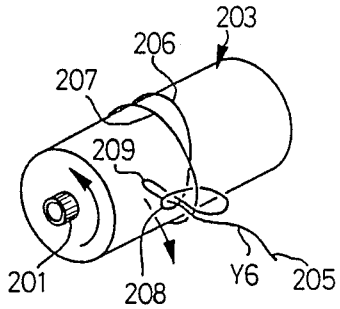
Figure 30E:
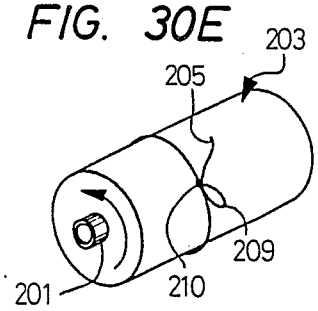

At first, as shown in FIG. 30A, a yarn end segment 205 is made loose to form an outer loop and an inner loop 207, and then a hooked loop 208 is formed with a yarn segment Y6 of the outer loop 206 as shown in FIG. 30B whereafter the hooked loop 208 is passed through the inner loop 207. After then, the hooked loop 208 is twisted to the left (or to the right) as shown in FIG. 30C, and then a drawing loop 209 is formed with the yarn segment Y6 of the outer loop 206 whereafter the drawing loop 209 is drawn over the inner loop 207 and passed through the twisted hooked loop 208 from above to below. Thereafter, a package 203 is rotated in a direction to wind the yarn onto the package 203 as shown in FIG. 30D while the drawing loop 209 is pulled in a direction opposite to the winding direction, thereby forming a knot 210 on an outer periphery of the package 203 as shown in FIG. 30E.

Also in the present embodiment, if the yarn end segment 205 of the knot 210 is pulled, the knot 210 can be untied readily.

As apparent from the foregoing description, according to the present invention, following good effects can be anticipated.

(1) As an end segment of a yarn of an outermost layer is bound to an outer periphery of a package, the yarn will not become loose, and handling of the package after then can be effected without a trouble.

(2) As a knot is formed such that a yarn segment thereof may be wrapped around an outer periphery of a package, the knot can be formed firmly on the outer periphery of the package without the yarn becoming loose upon binding.

(3) If an end of a yarn of a knot is pulled, the knot can be united readily so that it can be used readily at subsequent steps.

(II) Bunch Winding Processing Devices

The bunch winding processing devices 5, 6 are located at the second stage ST2 and the third stage ST3 of FIG. 1, respectively, and the package P1 for which yarn knotting has been completed at the first stage ST1 is fed by one pitch to the second stage at which operations to release and draw out a bunch winding portion of a yarn from the package. After then, while a yarn segment drawn out at the second stage is held sucked in the suction pipe of the second stage, the package P2 is fed to the third stage ST3 at which a yarn end segment of a predetermined length, for example, a length corresponding to 1.5 times the length of the outer periphery of the bobbin, is wrapped around an end portion of the bobbin and is fit into a slit of the bobbin so as to secure the yarn end segment to the bobbin with an end segment of the yarn of a length of several centimeters or so left extended outside from the slit so as to facilitate drawing out of the yarn end segment at a subsequent step.

(II-i) Bunch Winding Yarn Releasing and Drawing Out Mechanism

Figure 19A:
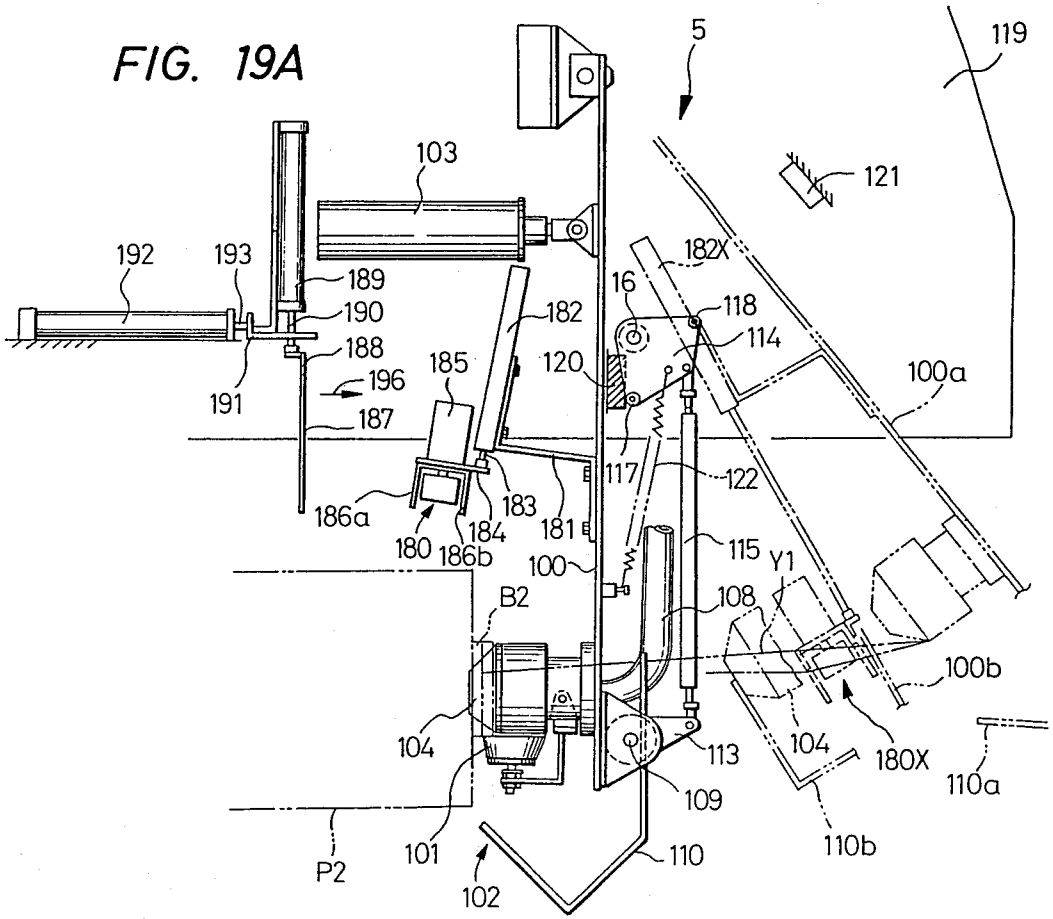
FIG. 19A is a side elevational view showing a device for releasing a bunch winding yarn at the second stage, FIG. 19B a side elevational view showing an operation of drawing out a yarn in a slit, FIG. 19C a front elevational view of a guide member 187, FIG. 19D an explanatory view showing a relation between forces when a yarn is drawn out, FIG. 19E a bottom plan view of a drawing out roller 180, FIG. 20 a side elevational sectional view of essential part of the device of FIG 19A, FIG. 21 a front elevational view of essential part of the device of FIG. 19A, FIG. 22 a view showing a step of releasing a bunch winding yarn, FIG. 23 a plan view of essential part showing a yarn wrapping and fixing device at the third stage, FIG. 24 a front elevational view of the yarn wrapping and fixing device of FIG. 23, FIG. 25 a right-hand side elevational view of FIG. 24, FIG. 26 a left-hand side elevational view of FIG. 24 showing a yarn end position controlling guide, FIG. 27 a perspective view showing a package after completion of the processing operations, FIG. 28 a view illustrating operation at the third stage, FIGS. 29A to 29F views of a step illustrating a yarn knotting process of the present invention, and FIGS. 30A to 30E views of a step showing another embodiment of the present invention.
Figure 20:
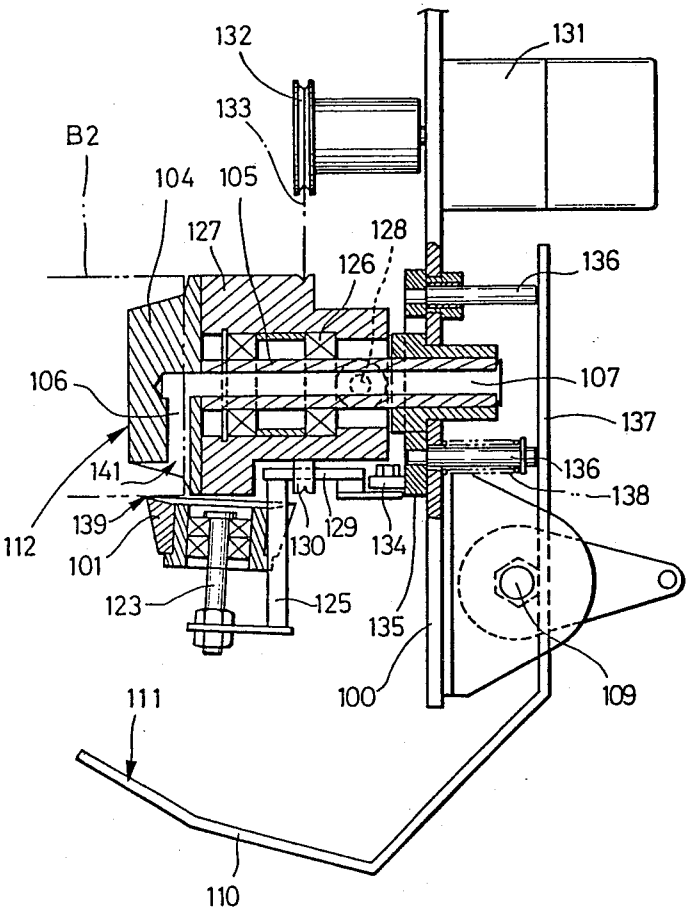

Referring to FIG. 19A, the bunch winding yarn releasing and drawing out mechanism 5 located at the second stage is shown. The bunch winding yarn releasing and drawing out mechanism 5 includes a bunch winding yarn releasing roller 101 and a yarn end sucking and grasping device 102 both located on a pivotal lever 100 which is mounted for pivotal movement toward and away from an end face of a bobbin B2 of a package P2 positioned and secured to a predetermined location of the second stage. In particular, the lever 100 is pivoted between a stand-by position 100*a* and an operative position 100 by a hydraulic cylinder 103, and a fixed support member 104 adapted to be fit in a hole of a bobbin B is securely mounted on an end face of a pipe 105 at an end portion of the lever 100 as shown in FIG. 20. A path 106 for suction air is formed in the support member 104 so as to open at an outer periphery of the support member 104 and communicates with a center hole 107 of the pipe 105, and a suction pipe 108 in FIG. 19A is connected to the pipe 105.

Further, a yarn holding plate 110 is mounted for pivotal motion around a shaft 109 on the lever 100 and has a yarn holding face 111 which, when the yarn holding plate 110 is rendered operative, is abutted with an end face 112 of the support member 104 to grasp a yarn therebetween. In particular, the yarn holding lever 110 is secured to the pivot shaft 109 to which another lever 113 is secured, and a rod 115 is connected between an end portion of the lever 113 and a rockable plate 114 mounted at an upper location of the pivotal lever 100. The rockable plate 114 is mounted for rocking motion around a shaft 116 and is rocked between two positions by operation of a pair of cam rollers 117, 118 supported at opposite end portions of the rockable plate 114 and a pair of cam pieces 120, 121 secured to a body frame 119 near opposite end portions of a locus of pivoting motion of the pivotal lever 100. Reference numeral 122 denotes a spring connected between the plate 114 and the lever 100. Accordingly, when the pivotal lever 100 is pivoted to the operative position shown in solid lines, the cam roller 117 is pushed by the cam piece 120 so that the yarn holding plate 110 is moved to its inoperative position shown in solid lines via the rod 115. But as the lever 100 is pivoted away from the solid line position to move the cam roller 117 away from the cam piece 120, the yarn holding plate 110 is pivoted in a clockwise direction around the shaft 109 by a force of a spring 122, thereby holding and grasping a yarn between the yarn holding plate 110 and the end face of the support member 104.

Meanwhile, the bunch winding releasing roller 101 is supported by means of a pair of support brackets 124 and a rod 125 so that it may rotate freely around a shaft 123 and revolve along an outer periphery of the bobbin B2. In particular, the brackets 124 are coupled by means of a pin 128 to a rotary member 127 which is supported for rotation on an outer periphery of the pipe 105 by means of a bearing 126, and a plate 129 is secured to the rod 125 and is supported for limited rocking motion around the pin 128.

A pulley 130 is formed in an integral relationship on the rotary member 127 and is driven to rotate by a motor 131 via another pulley 132 and a belt 133. Further, a cam roller 134 is secured to the support plate 129 and is pressed against a pressing plate 135 so that as the pressing plate 135 is moved leftwardly or rightwardly, the cam roller 134 is displaced to displace the cam roller 101 around the pin 128 of the rotary member 127 into or out of contact with a circumferential face of the bobbin. A pair of pins 136 are secured to the pressing plate 135 and extend through the lever 100 until they are each abutted with a portion 137 of the yarn holding plate 110 by a force of a spring 138. Accordingly, in a state shown in FIG. 20, that is, in an operative position for releasing a bunch winding yarn, the yarn holding plate 110 assumes a solid line position in which they push the pins 136 against the springs 138 so that the pressing plate 135 pushes the cam roller 134 to press the roller 101 against the circumferential face of the bobbin while the motor 131 is driven to revolve the roller 101 around the circumferential face of the bobbin. Meanwhile, in an intermediate position **100*b* of the lever 100 shown in FIG. 19A, the pressing plate 110 is displaced to a position 110*b* shown in the same figure in which it is out of contact with the pins 136 so that the pressing plate 135 is moved rightwardly by the force of the spring 138 until it is abutted with a face of the lever 100. Consequently, the roller 101 has a position spaced away from the circumferential face of the bobbin. It is to be noted that the rotary shaft 123 of the roller 101 is a little inclined relative to the axis of the bobbin, and at the present stage, the roller 123 is rotated with the end face 139** thereof contacted with the circumferential face of the bobbin so that a yarn layer on the slit may be pulled out toward the bobbin end face side.

Figure 22:
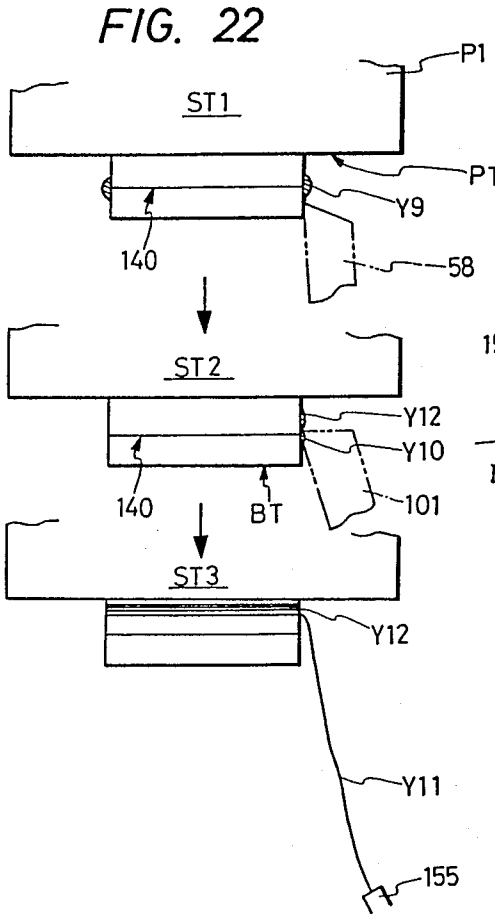

In particular, as illustrated in FIG. 22, upper ones of bunch winding layers Y9 wound over a slit 140 are forced toward a package end face PT side by the roller 58 at the first stage ST1, and then at the second stage ST2, yarn layers Y10 on the slit 140 are drawn out in order to draw out a winding starting end segment of a yarn of a package P2 which is caught in the slit 140. In particular, as yarn layers are displaced toward the bobbin end face BT side by the roller 101 and thus become loose and are finally dropped from the bobbin end face BT, a segment of the yarn is sucked into a suction opening 141 of the support member 104 shown in FIG. 20, and then as the lever 100 is moved to the intermediate position **100*b* shown in two-dot chain lines in FIG. 19, a segment of the yarn extending between the bobbin and the suction opening 141 is clamped between the holding plate 110 and the support member end face 112 so that the yarn end segment caught in the slit 140 is compulsorily drawn out from the slit 140. It is to be noted that drawing out of the yarn end segment can be further assured if such movement of the lever 100 between the full line position and the intermediate position 100*b* shown in FIG. 19A** is repeated several times.

Referring to FIG. 19A, the arm 100 further has a yarn drawing out roller 180 mounted thereon. In particular, a hydraulic cylinder 182 is mounted on a bracket 181 secured to the arm 100. A support plate 184 is secured to a piston rod 183 of the cylinder 182, and as shown in FIGS. 19A, 19E, the support plate 184 has mounted thereon a pair of drawing out rollers **180*a*, 180*b*, a motor 185 for driving the rollers 180*a*, 180*b*, a pair of guide plates 186*a*, 186*b* for guiding a segment of a yarn to a nip point of the rollers 180*a*, 180*b* and some other elements. Accordingly, the drawing out roller device 180 is moved from the full line position of FIG. 19 via a two-dot chain line position 180*x* guiding a yarn Y1 to the operative position of FIG. 19A**.

Figure 19B:
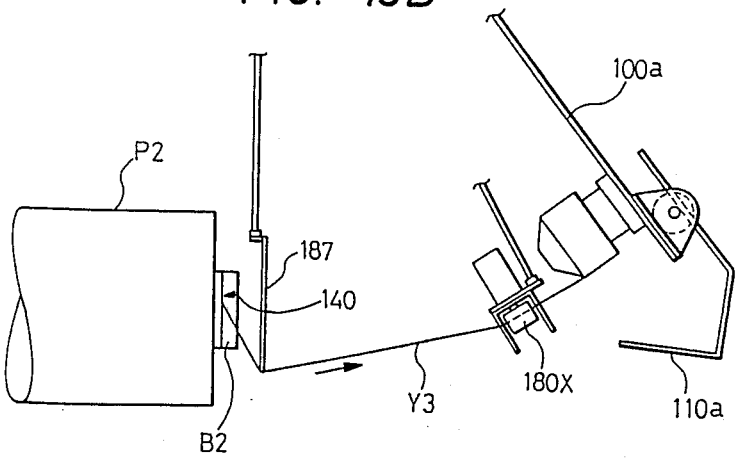

Further, a yarn guide member 187 as shown in FIGS. 19, 19B is mounted for movement in a direction parallel to the axis of the package and also in a direction perpendicular to the axis of the package on the frame 119 at the second stage at which the arm 100 is installed. The guide member 187 is formed as a ring 187 having a greater diameter D than the outer diameter d of the bobbin B2 as seen in FIG. 19C, and the ring 187 is secured to a support rod 188. As shown in FIG. 19A, the support rod 188 is securely mounted on a piston rod 190 of a hydraulic cylinder 189 and is moved by the latter in an upward or downward direction in FIG. 19A. The hydraulic cylinder 189 is secured to a bracket 191 which is in turn secured to a piston rod 193 of another hydraulic cylinder 192 supported on the frame 119 so that the ring 187 is moved also in a leftward or rightward direction in FIG. 19A as the hydraulic cylinder 192 operates.

Thus, when part of a bunch winding yarn is drawn out and a segment of the yarn is extended as shown in a two-dot chain line Y1 in FIG. 19A, the hydraulic cylinder **182*x* is rendered operative so that drawing out rollers 180*x* are lowered to a position shown in FIG. 19A until the yarn segment is nipped between the rollers 180*a*, 180*b* so as to draw out the yarn by rotation of the rollers 180*a*, 180*b* in directions indicated by arrow marks 194, 195 in FIG. 19E. Then, after at least slackening of the yarn segment between the bobbin B2 and the rollers 180*x* has disappeared, that is, after an interval of time after operation of the cylinder 182*x* which may be suitably preset, the cylinder 192 of FIG. 19A is rendered operative to move the ring 187 from the stand-by position in a direction indicated by an arrow mark 196, that is, in a direction of the axis of the bobbin, and then the cylinder 189 is rendered operative to move the ring 187 down to the position 187 shown in FIG. 19A. Upon such downward movement of the ring 187, the yarn segment Y1 which extends linearly between the slit 140 and the rollers 180*x* is engaged with the outer periphery of the ring 187 and thus undergoes a compulsory bending action as at a yarn segment Y3 in FIG. 19A. In this state, the drawing out action of the rollers 180x** is further continued.

Accordingly, a tensile force F applied to the yarn segment Y3 by the drawing out action of the rollers acts upon a portion of the yarn within the slit 140 at an angle relative to the axis of the bobbin which angle is determined by the outer diameter of the ring 187 and is separated into a component f1 of a force acting in parallel to the bobbin axis and another component f2 acting in a direction perpendicular to the bobbin axis upon the yarn portion caught in the slit 140. In particular, the component f2 acts as a force to draw the yarn portion in the slit 140 formed in the outer periphery of the bobbin in a radial direction of the bobbin out of the slit 140, thereby facilitating releasing of the yarn portion from the slit.

Accordingly, as the force f2 becomes greater, a yarn caught firmly in the slit can be drawn out more easily. Accordingly, it is desirable to maximize the diameter D of the ring 187 within a range given by the structure of the arrangement.

Figure 19C:
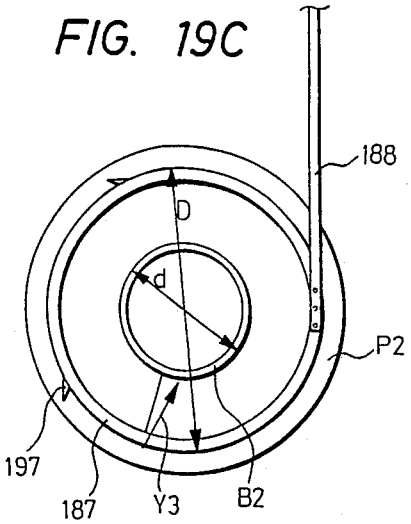
Figure 19D:
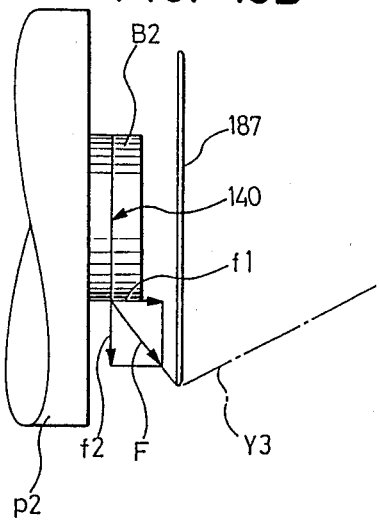
Figure 19E:
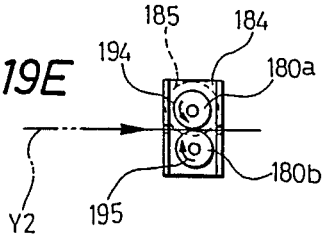
Figure 21:
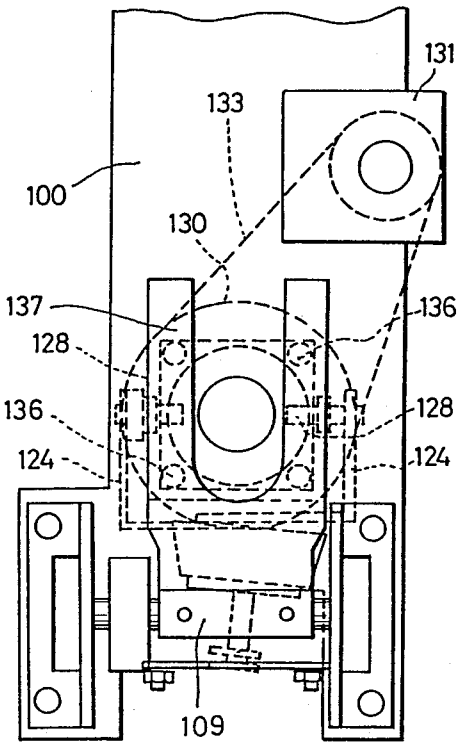

It is to be noted that while the guide member 187 in the embodiment described above is formed as a ring, it is also possible to employ as the guide member 187 a member in the form of a mere disk or a member having a non-circular outer periphery. Meanwhile, a projection 197 formed at a portion of the ring 187 in FIG. 19C is provided for controlling a passage of a yarn when a package is moved from the second station to the third station (FIG. 1).

The yarn Y11 drawn out as described above is detected by a sensor 142, and in response to such detection signal, the package is fed to the third stage.

(II-ii) Yarn End Fixing Mechanism

At the third stage ST3 shown in FIG. 1, the yarn segment drawn out at the second segment is further released so as to release the bunch winding yarn layers Y12 displaced toward the package side shown in FIG. 22, and a portion of a predetermined length of the yarn end segment which connects to the innermost yarn layer of the package and is impossible to release is wrapped in several turns around an end portion of the bobbin and is partly pushed into the slit in order to fix the yarn end segment, whereafter the yarn end segment is cut so that an end segment of the yarn of a length of several centimeters may remain exposed outside the slit.

Figure 23:
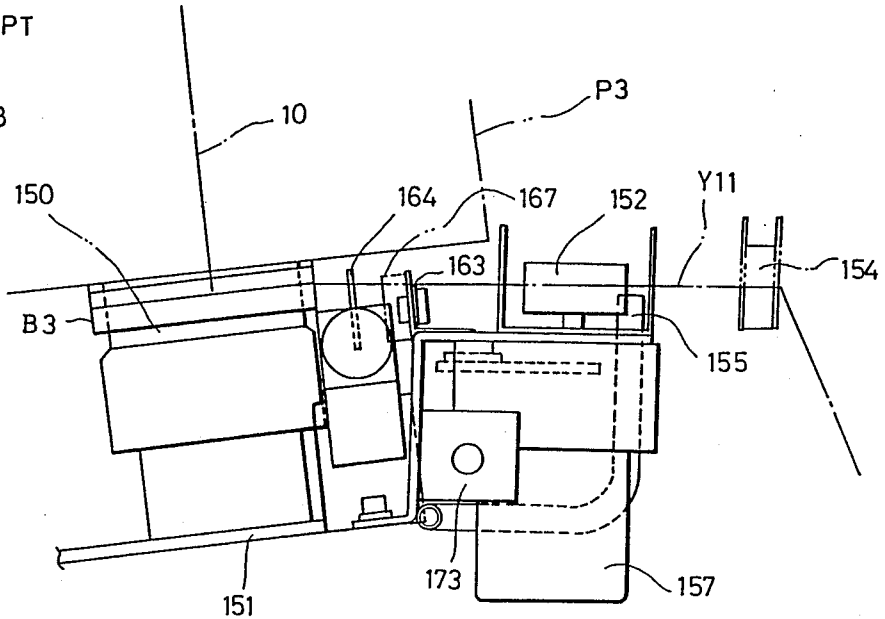

FIG. 23 is a plan view of the third stage. In the third stage, a package supporting rotary member 150 is formed in a similar construction to that of the chucking device 38 of the first stage in that it is mounted on a package supporting member 150. In particular, the frame 151 shown in FIG. 23 is slidably moved in a direction of the axis of the package P3 until the chuck 150 is advanced into the bobbin B3 of the package so that the package may be grasped likewise by a mechanism similar to the chuck mechanism shown in FIG. 9.

Figures 24, 25, 26:
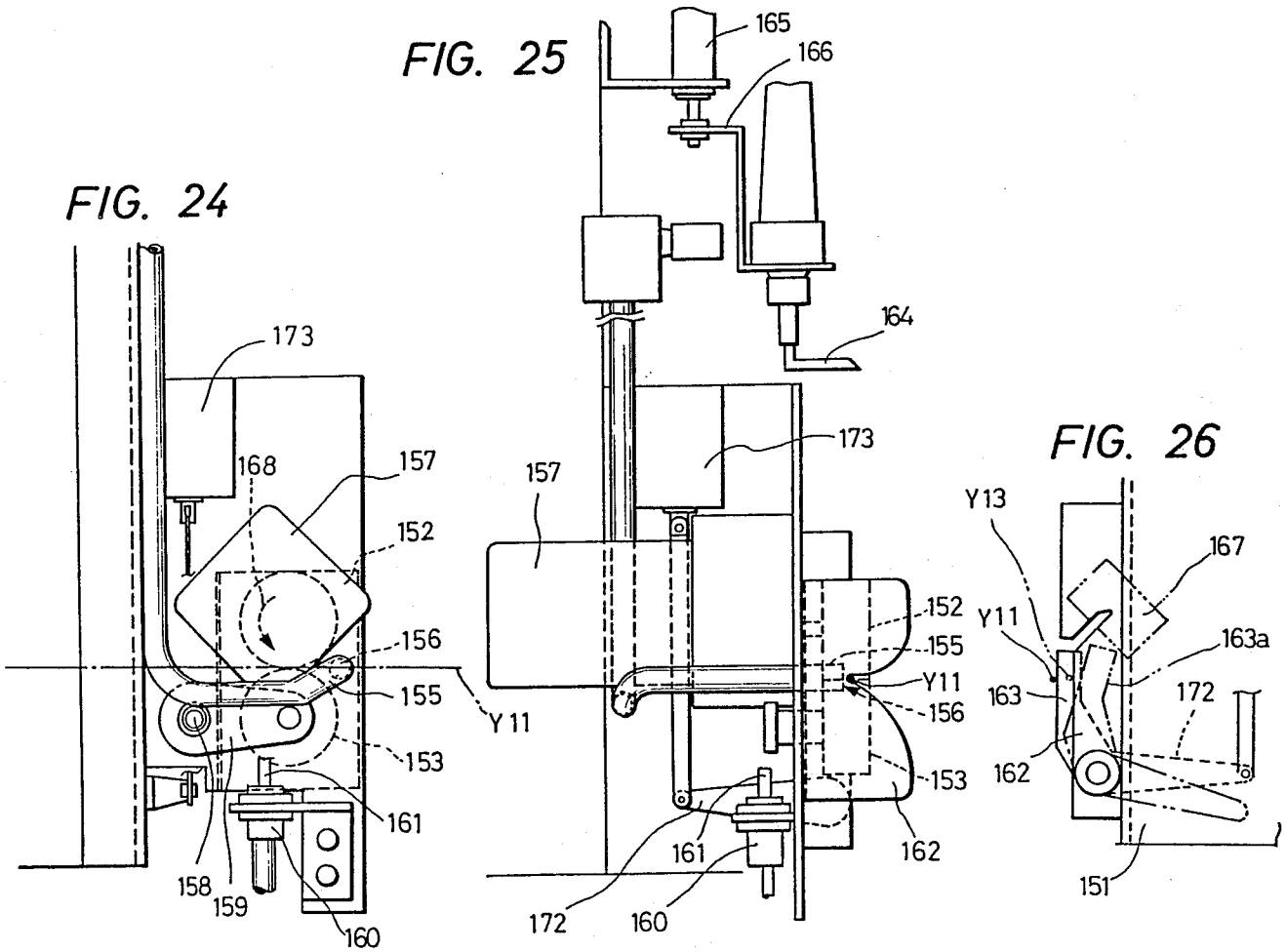

The frame has a pair of rollers 152, 153 mounted thereon for further releasing a yarn connecting to the sucking means of the second stage, and a sucking opening 156 of a yarn end sucking and holding pipe 155 is located between the pair of rollers 152, 153 and the cutter provided at the second stage. Referring to FIGS. 23 to 25, one 152 of the pair of rollers 152, 153 is connected to be driven by a motor 157 supported on the frame 151 while the other roller 153 is supported for rotation on a lever 159 mounted for rocking motion on a shaft 158 and is pressed against the driving roller 152 by an action of a pushing up rod 161 either of a hydraulic cylinder 160 or of a solenoid so that it may be rotated by the driving roller 152. Reference numeral 162 denotes a guide plate for guiding the yarn Y11 to a position between the rollers 152, 153.

Further, referring to FIGS. 23 and 26, a fixed guide plate 162 and a movable guide plate 163 for wrapping a segment of a yarn of a predetermined length around the bobbin and for guiding the same into the slit are mounted on the frame 151 in the neighborhood of the bobbin B3. Reference numeral 164 denotes a cutter device located between the bobbin B3 and the guide plate 162. The cutter device is a heat cutter similar to that of the first stage, and the heat cutter 164 is placed on a bracket 166 which is moved up and down by a hydraulic cylinder 165 as shown in FIG. 25. The heat cutter 164 is thus effective to fusion weld ends of fibers at an end of the yarn also in order to prevent the cut end of the yarn from getting loose. Reference numeral 167 in FIGS. 23, 26 denotes a sensor for detecting a yarn.

Now, operation of the third stage will be described.

The yarn segment Y11 extending between the package P3 fed from the second stage to the third stage and the suction pipe of the second state is cut by the cutter 164, and a cut end portion of the yarn is sucked into the suction pipe 155. Then, as the rollers 152, 153 are rotated in a direction indicated by an arrow mark in FIG. 24, the bunch winding yarn is further released, and then when all the bunch winding yarn is released, the nip point of the yarn provided by an inner layer of the package (that is, a point N at which further releasing is impossible) is moved in a direction of an arrow mark 170 from its lowermost position by rotation of the package P3 in a direction of another arrow mark 169 so that the yarn segment Y11 between the nip point N and the roller 152 is moved from a full line position to a two-dot chain line position Y11*a*. The sensor 167 detects the yarn segment only after such movement of the latter and thus delivers an on signal in accordance with which it is determined that releasing of the bunch winding yarn has been completed. Accordingly, a subsequent yarn laying operation and a yarn end fixing operation are started.

Figure 27:
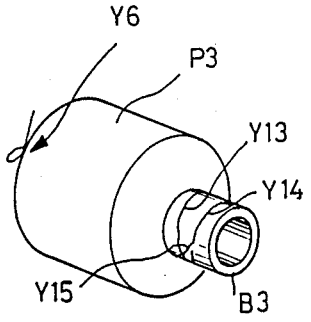
Figure 28:
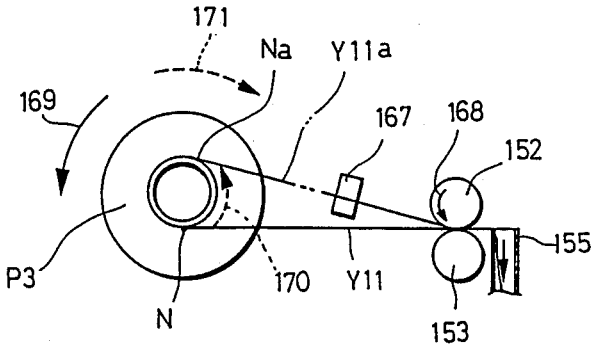

In particular, the package P3 starts its reverse rotation 171 at a point of time the sensor 167 is turned on. Such rotation of the package P3 in a direction of an arrow mark 171 is continued for a period of time preset by a timer so that the yarn segment sucked in and held by the suction pipe 155 is drawn out of the pipe 155 and wrapped around the surface of the bobbin. In this instance, the wrapping position is controlled by the movable guide plate 163 of FIG. 26 while the position of the yarn segment is a position Y13 on the package end face side of FIG. 27. Thus, at a point of time when the yarn is wrapped over about 1.5 times the entire periphery of the package, the lever 172 of FIG. 26 is pulled down by a solenoid 173 due to an action of the timer so that the movable plate 163 is retracted to its two-dot chain line position 163*a* while the yarn Y14 is controlled by the fixed guide plate 162. Since this yarn position Y14 coincides with the position of the slit 140 of the bobbin, as in this condition the package is further rotated in the direction of the arrow mark 171 in FIG. 28, the yarn is fit into the slit 140 and thus secured to the latter. It is to be noted that since the roller 152 is positively rotating in the direction of the arrow mark 168 whether the package P3 of FIG. 28 is rotated in the direction of the arrow mark 169 or in the direction of the arrow mark 171, the yarn segment Y11*a* is wrapped under a predetermined tensile force so that it can be fit into the slit 140.

At a point of time when fitting of the yarn into the slit is completed, that is, upon lapse of a preset time at a timer, the cutter device 164 of FIGS. 23, 25 is rendered operative so that cutting of the yarn segment is effected at a position spaced by a predetermined distance near the bobbin, thereby completing the processing of the bunch winding yarn. In particular, a state as shown in FIG. 27 is reached wherein the yarn segment of a predetermined length is wrapped Y13 around an end portion of the bobbin and secured Y14 by the slit and besides the end portion Y15 of the yarn of a length of several centimeters is extended outside from the slit.

After completion of the processing steps at the first to third stages described above, such a package as shown in FIG. 27 is delivered from the third stage and transported to a subsequent next step.

As described in detail so far, in the present embodiment, a processing operation for formation of a knot of a yarn as illustrated in FIG. 14 and a processing operation for preparation of a bunch winding yarn are effected at the first stage, and then at the second and third stages, releasing of the bunch winding yarn and fixation of an end of the yarn are effected. Accordingly, time can be saved comparing with a processing system wherein all necessary processing operations are effected at a single stage.

As apparent from the foregoing description, according to the present invention, a knot of a yarn on an outer layer of a package can be formed at a predetermined position, and a bunch winding yarn at an end face of the bobbin can be released and an end segment of the yarn of a predetermined length can be formed at an end portion of the bobbin. Accordingly, it is assured at a subsequent step or steps that a yarn end drawing out operation for releasing of the yarn of the package and an operation of drawing out an end of the yarn on the inner layer side of the package in order to splice it to another yarn of a different package can be facilitated.

What is claimed is:

1. A device for processing a yarn of a package, characterized in that a device for processing the yarn of an outer yarn layer of the package and a device for processing a bunch winding yarn of the package are disposed along a feeding path for the package, and that said device for processing the yarn of an outer yarn layer includes a yarn knotting device for joining the yarn of the outer layer of the package at a predetermined position of a surface of the package to form a knot of the yarn while said device for processing a bunch winding yarn includes a mechanism for releasing the bunch winding yarn at an end portion of a bobbin and a mechanism for wrapping a segment of the yarn around the end portion of the bobbin in order to fix the yarn segment.

2. A device for processing a yarn of a package as claimed in claim 1, wherein said yarn knotting device comprises a waste yarn removing mechanism for removing waste yarns wound on an outermost yarn layer of a package and a yarn knotting mechanism, said waste yarn removing mechanism including a suction pipe mounted for sliding movement in parallel to an axis of a package near an outer periphery of the package and for pivotal motion at a position thereof adjacent an end of the package in a direction perpendicular to the axis of the package, and a waste yarn removal confirming sensor.

3. A device for processing a yarn of a package as claimed in claim 2, wherein said waste yarn removal confirming sensor has a yarn sensing groove which is positioned within a locus of balloon produced on the completion of the removal of the waste yarn releasing and a guide plate, and a next yarn knotting step is entered as the sensor detects a yarn and the removal of the waste yarn is confirmed.

4. A device for processing a yarn of a package as claimed in claim 3, wherein said waste yarn removing mechanism further includes yarn end releasing nozzles, which are provided at a location opposing to the waste yarn portion of the package and jet compressed air in a direction tangential to the surface of the package to release the yarn from the package, and a yarn end dropping preventing plate so as to cover the package so that air is jetted from the yarn end releasing nozzle in response to a yarn absence signal from the sensor.

5. A device for processing a yarn of a package as claimed in claim 1, wherein said yarn knotting mechanism comprises a package grasping and rotating device, a yarn laying device for scooping up a portion of a yarn on an outer layer of a package and for forming a loop of the yarn at a location spaced away from a surface of a package, a bill device for receiving a yarn segment from the yarn laying device and for knotting the same, and a cutter device for cutting a yarn segment extending to the suction pipe after completion of knotting of the yarn.

6. A device for processing a yarn of a package as claimed in claim 5, wherein said yarn knotting mechanism is mounted on a slide frame which is slidably moved along a guide rod extending in parallel to an axis of a package.

7. A device for processing a yarn of a package as claimed in claim 6, wherein a package grasping and rotating chuck device is further mounted on the slide frame and the package grasping and rotating chuck device comprises a shaft extending through the slide frame and being supported rotatably, a fixed chuck member secured to the shaft, a first movable chuck member in the form of a disk being screwed to a package side end of a rod movably inserted in the shaft, a second movable chuck member interposed between the fixed chuck member and the first movable chuck member, and pressing pieces consisting of ring-shaped coil springs for pressing against an inner circumferential face of a bobbin of a package and fitted to and coiled on the chuck members.

8. A device for processing a yarn of a package as claimed in claim 5, wherein said yarn laying device includes a rotary ring for internal contact with guide rollers secured to an end face of a base member in the form of a disk secured to the slide frame, and a spiral yarn hanging guide secured to an end portion of a shaft which is located on the rotary ring in an integral relationship to the axis of the package.

9. A device for processing a yarn of a package as claimed in claim 1, wherein said mechanism for releasing the bunch winding yarn includes a pivotal lever which is mounted for pivotal movement toward and away from an end face of a bobbin of a package, a bunch winding yarn releasing roller, and a yarn sucking and grasping device both located on the pivotal lever.

10. A device for processing a yarn of a package as claimed in claim 9, wherein a fixed support member adapted to fit in a hole of a bobbin and a yarn holding plate which may be abutted with an end face of the support member to grasp a yarn therebetween are mounted on the end portion of said pivotal lever, said support member having a suction means provided therein.

11. A device for processing a yarn of a package as claimed in claim 9, wherein said mechanism for releasing the bunch winding yarn further includes a yarn drawing out means comprising a pair of drawing rollers, mounted on the pivotal lever, a motor for driving the rollers, a pair of guide plates for guiding a segment of a yarn to a nip point of the rollers.

12. A device for processing a yarn of a package as claimed in claim 1, wherein a yarn grasping member mounted for movement between a position in which said yarn grasping member is located near an end portion of a bobbin of the package and holds part of the bunch winding yarn and another position in which said yarn grasping member is spaced in a direction of an axis of the package, and a yarn guide member located between said yarn grasping member at the position spaced away from the package and end face of the bobbin of the package and mounted for movement in a direction perpendicular to the direction of an axis of the package.

13. A device for processing a yarn of a package as claimed in claim 12, wherein said yarn grasping member is a yarn drawing out means.

14. A device for processing a yarn of a package as claimed in claim 12, wherein said yarn guide member comprises a ring having a greater diameter than the outer diameter of the bobbin.

15. A device for processing a yarn of a package as claimed in claim 1, wherein said mechanism for wrapping a segment of the yarn comprises a slide frame movable along an axis of a package, a package supporting rotary member provided on the slide frame and having a chuck member which may be advanced into a bobbin of a package to grasp the package thereby, a pair of rollers for releasing a yarn, a yarn end sucking and holding pipe, and a fixed guide plate and a movable guide plate for wrapping a segment of a yarn of a predetermined length around the bobbin and for guiding the same into a slit.

16. A device for processing a yarn of a package as claimed in claim 15, wherein said mechanism for wrapping a segment of the yarn further includes a cutter device provided between the fixed guide plate and the bobbin, and a sensor for detecting a yarn.

17. A yarn knotting process for knotting an end segment of a yarn of an outer yarn layer of a package including a bobbin on which the yarn is wound to an outer periphery of the package, characterized in that it comprises the steps of making the end segment of the yarn of the outer yarn layer loose to form on the outer periphery of the package an outer loop connecting to the yarn end segment and an inner loop connecting to the outer loop, forming a hooked loop from part of the yarn of the outer loop and passing the same through the inner loop, forming a drawing loop from a segment of the yarn between the hooked loop and the end of the yarn, passing the drawing loop over the inner loop and then through the hooked loop, and rotating the package in a direction to wind the yarn onto the package while the drawing loop is pulled in a direction opposite to the direction of rotation of the package to form a knot of the yarn.

* * * * *